United States Patent [19]

Watanabe et al.

[11] Patent Number: 4,667,481

[45] Date of Patent: May 26, 1987

[54] METHOD OF AND APPARATUS FOR EMITTING LIGHT IN ICE

[75] Inventors: Koji Watanabe; Mitsuo Watanabe; Naoki Toyoda; Hideo Toyoda; Toshio Kumano; Michiaki Hiramoto, all of Tokyo, Japan

[73] Assignee: Hitachi Plant Engineering & Construction Co., Ltd., Japan

[21] Appl. No.: 767,435

[22] Filed: Aug. 20, 1985

[30] Foreign Application Priority Data

Sep. 11, 1984 [JP] Japan ..... 59-189980
Jun. 3, 1985 [JP] Japan ..... 60-119995

[51] Int. Cl.[4] ..... A63C 19/10

[52] U.S. Cl. ..... 62/235; 62/264; 362/800

[58] Field of Search ..... 62/235, 264; 362/800, 362/92

[56] References Cited

U.S. PATENT DOCUMENTS 2,732,688 1/1956 Dickson ..... 62/264 X
4,254,451 3/1981 Cochran, Jr. ..... 362/800 X
4,521,835 6/1985 Meggs et al. ..... 362/800 X

*Primary Examiner*—William E. Wayner
*Attorney, Agent, or Firm*—Parkhurst & Oliff

[57] ABSTRACT

The present invention relates to a method of and an apparatus for emitting light in ice, to be applied to an ice skating rink and the like. With the apparatus for emitting light in ice according to the present invention, when light emission sources are light emitting diodes (LED), LED mounting blocks are used and laid on a concrete floor, so that mounting works can be facilitated. Additionally, LED are used as the light emission sources, so that a possibility of ice melting can be eliminated. Furthermore, with the apparatus for emitting light in ice according to the present invention, when miniature incandescent bulbs are used as the light emission sources, the miniature incandescent bulbs disposed in transparent vinyl chloride tubes are laid on the concrete floor, so that a special water-proof measure can be dispensed with. Furthermore, air is delivered into the tube, whereby heat in the tube is prevented from being stagnant in the tube, so that the ice melting is avoided.

3 Claims, 25 Drawing Figures

METHOD OF AND APPARATUS FOR EMITTING LIGHT IN ICE

BACKGROUND OF THE INVENTION

1. Field of the Invention

This invention relates to a method of and an apparatus for emitting light in ice, and more particularly to a method of and apparatus for emitting light in ice, which are applied to a decorative ice wall surface, an ice decorating using an ice pillar, an ice carving and the like in an ice skating rink, a hotel lobby and the like.

2. Description of the Prior Art

It has become difficult to attain a satisfactory customer attracting capacity with the conventional skating rink for a mere skating in the field of the skating rinks for the leisure under the influence of the diversification of the leisure industry in recent years. More specifically, in the ice skating rink making the entertainment business the first object, needless to say that the quality of ice on the rink is improved, and moreover, various elaborate plans are devised as added functions of the rink in such a manner that various patterns are drawn by use of colors in the ice and a material reflecting light from outside is taken into the ice. Furthermore, even in the ice skating rink for sports events, there are used methods of coloring in the ice for drawing lines such as a track line for the speed skating, a line for a game of ice hockey, and the like. Additionally, in some indoor skating rink or other, lightings by a laser beam, a cocktail light, a mirror ball and the like are projected from a top space on the ceiling so as to improve the amusement value in the indoor ice skating rink.

As a method of emitting the light in the ice, it is devisable that light emitting means such as electric bulbs are embedded in the ice and turned on. However, with the above-described light-emitting means, a water-proof measure is required for emission sources thereof, the temperature of ice is raised by the heat from the emission sources, thus causing the ice to be melted. Furthermore, if a skater jumps on the ice skating rink or a rink cleaning car passes through the rink, then an excessively high load acts on the emission sources, thus possibly damaging the electric bulbs and the like.

Further, since the light is emitted in the ice, there is a possibility that the light emitting effect being fit for decoration cannot be attained due to the degree of transparency of the ice, etc., the type and brightness, etc. of the lightings.

It is proposed that the apparatus for emitting light in the ice is of such an arrangement that a heat insulating material is laid on a base floor, the aforesaid emission sources are rested on the heat insulating material, water is gradually frozen by cooling pipes and fixed in the form of ice. However, a mere locating of the emission sources on the floor presents the disadvantages that the irradiating surfaces of the emission sources are crooked during the process of solidification of the ice, and the intervals between the emission sources are shifted to be irregular, whereby a figure to be drawn is distorted, so that clearness is lost. In the ice skating rinks, normally, it takes about one week to finish the skating surface. In consequence, it is impossible to set up the emission sources again unless the whole surface of the ice skating rink is molten when the emission sources are shifted or distorted in the ice, and unclear portions or deformed portions are formed in predetermined figures and patterns.

Furthermore, with the emission apparatus of the type described, in the case of incandescent bulbs for example, the scattering of light in the ice is high, whereby most of the emitted light quantity is scattered in the ice, so that the emission apparatus proves to be very low in the efficiency in drawing the figure, straight line and the like. Further, if the quantity of scattered light is excessively high, then such a disadvantage that the pattern to be drawn cannot be discriminated is presented.

Furthermore, the apparatus for emitting the light in the ice is utilized not only for the ice skating rink but also for a decorative ice. The decorative ice is used for raising interest in halls of wedding ceremony, various shows and the like. With these decorative ices, there are presented the disadvantages of the melting of ice and non-easiness in visual inspection of the light emitting bodies in the same manner as in the ice skating rink.

SUMMARY OF THE INVENTION

The present invention has been developed to obviate the above-described disadvantages of the prior art and has as its object the provision of a skating rink, which is added thereto with the amusement value to the lighting of the conventional skating rink, to thereby make the skating rink suited to an object of sports for amusement to enjoy the atmosphere.

To this end, the present invention contemplates that emission sources are provided in an ice layer whereby the surface of the rink is made luminant by emitted from the light emission sources and transmitted through the ice.

In other words, the present invention is based on the fact that the ice layer in the skating rink are transparent, and features that the light emitted from the emission sources provided in the ice layer and transmitted the ice layer brings about a unique soft color tone.

Furthermore, the present invention is based on a plurality of LED (light emitting diode) as emission sources in the ice. The LED is previously secured to a mounting block. These LED-mounting blocks are laid on a concrete floor, to thereby work the present invention. The LED is low in heat release value, has no possibility of melting ice, and does not require a special countermeasure in respect of water-proofing.

Furthermore, according to the present invention, as a method of color development from the ice in the ice skating rink, incandescent bulbs are installed in a light-transmitting tube, and this tube is embedded in the ice to cause the tube to develop color. The provision of the incandescent bulbs in the transparent tube makes it possible to make the incandescent bulb perfectly waterproof and make the laying works easy.

DETAILED DESCRIPTION OF THE INVENTION

Figure 1:
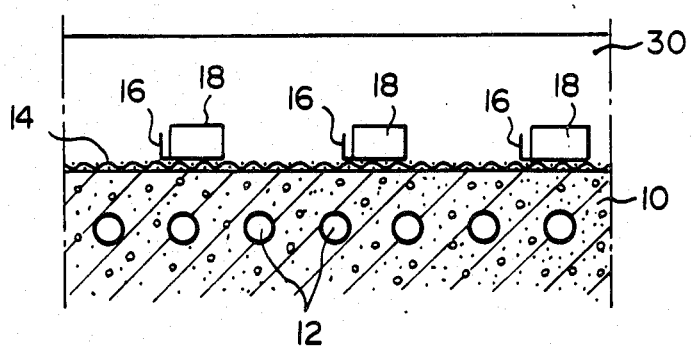
FIG. 1 is a sectional view showing the apparatus for emitting the light in the ice, having a LED as an emission source according to this working.

FIG. 1 shows an outline of the construction ot the apparatus for emitting the light in the ice, having the LED as the emission sources according to this working. As shown in FIG. 1, in a concrete floor, there are provided cooling pipes 12 at regular intervals. A cooling medium is passed through the cooling pipes 12. Provided on the top surface of the concrete floor 10 is a metal screen 14, on which LED-mounting blocks 18 are provided through L-shaped angles 16 at regular intervals.

Figure 2:
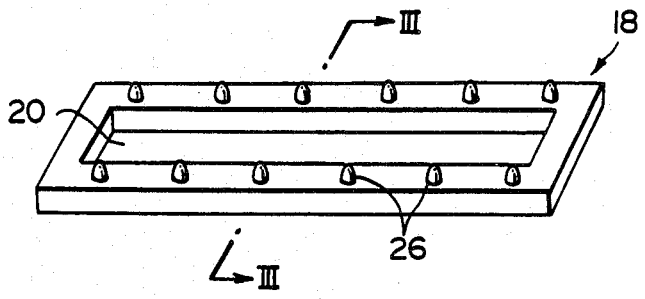
FIG. 2 is a perspective view showing the LED-mounting block.
Figure 3:
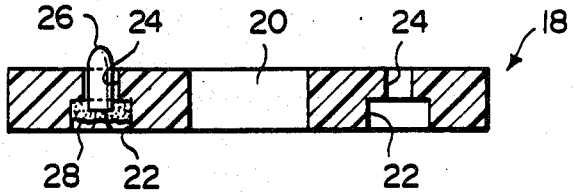
FIG. 3 is a sectional view showing the LED-mounting block, taken along the line III—III in FIG. 2.

This block 18 is made of transparent acrylic resin and formed at the central portion thereof with a cutaway opening 20 as shown in FIG. 2. This cutaway opening 20 is formed so that when the blocks 18 are laid on the surface of the concrete floor 10, the blocks 18 do not hamper the transmission of cooling heat from the cooling pipes 12. As shown in FIG. 3, recesses 22 are formed on opposite sides of the cutaway opening 20. These recesses 22 are each formed at the bottom thereof with a through-hole 24 for mounting the LED. The LED 26 is inserted from the bottom face of the block 18, through the recess 22 and the mounting hole 24, and secured to the block 18 by use of an acrylic bonding agent 28 for example as shown in FIG. 3, with the top portion of the LED 26 being exposed from the block 18 as shown in FIG. 2.

The block 18, being disposed along the angle 16, can be accurately mounted to a predetermined position without being wry. Furthermore, the angle 16 is secured to the metal screen 14, which uniformly diffuses the cooling heat from the cooling pipes and has a function of dissipating the heat from the LED without allowing such heat to be accumulated locally.

The blocks 18 are mounted as described above, and thereafter, an ice layer 30 is formed. This ice layer 30 is formed to have a thickness of 50 to 80 mm. According to this forming method, while the cooling medium is passed through the cooling pipes 12, water is sprayed in the thickness of 2 to 3 mm per cycle, and this spray is repeated predetermined cycles, to thereby form the ice layer 30. The reason why the quantity of sprayed water per cycle amounts to the thickness of 2 to 3 mm is that air bubbles are prevented from being produced during a process of forming the ice layer 30, the ice layer 30 is increased in its strength, the transparency of the ice layer is improved, and the light from the LED is easily transmitted.

Figure 4:
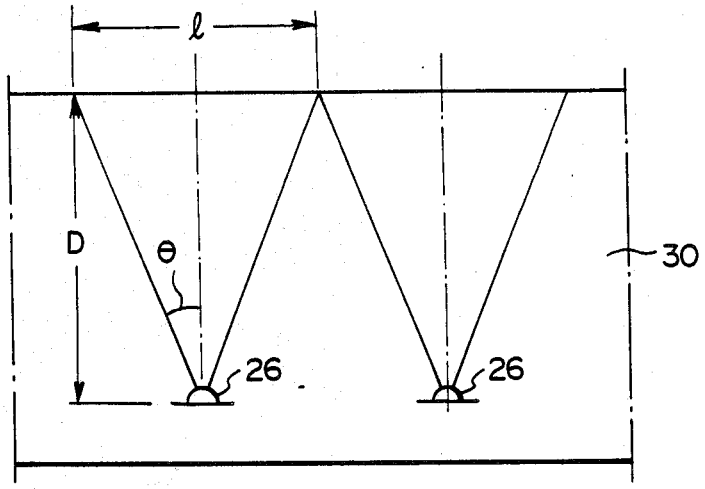
FIG. 4 is an explanatory view showing the mounting pitch of the LED.

Description will hereunder be given of the mounting interval. In FIG. 4, if an illumination intensity on the ice is 150 Lux, a temperature on the ice surface is −2° C. and a depth D of the ice layer is 50 mm, then an irradiation angle $\theta$ of the LED comes to be 10°-20°, whereby a pitch L becomes 30 mm. With this arrangement, if a plurality of LED are installed in every pitches l, then the lights from the plurality of LED are continuous in looking from above the ice.

Figure 5:
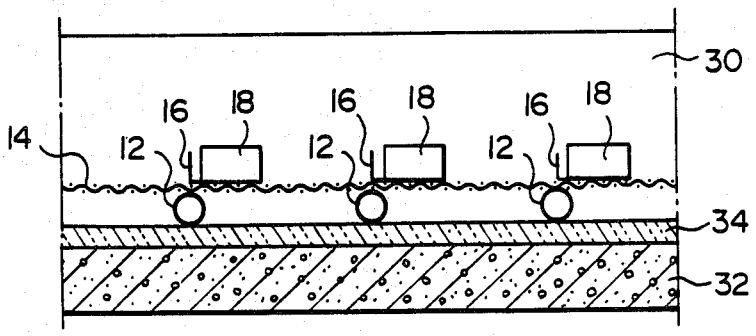
FIG. 5 is a sectional view showing a temporarily provided apparatus for emitting the light in the ice having the LED as the emission sources.

FIG. 5 shows an example of temporary works of an ice skating rink. The temporary works are used, when a pool, a gymnasium and the like for example are utilized as an ice skating rink during winter. In the case of a provisionally provided ice skating rink, as shown in FIG. 5, a heat insulating material 34 is disposed on a concrete floor 32, and the cooling pipes 12 are provided on this heat insulating material 34 at regular intervals. Further, laid on these cooling pipes 12 are a metal screen 14, on which are disposed L-shaped angles 16 at regular intervals. The block 18 having mounted thereon the LED 26 is provided on this L-shaped angle 16. The provisionally provided ice skating rink is constructed as described above. The method of forming the ice layer 30 is conducted such that, similarly to the working as described above, the quantity of sprayed water per cycle amounts to a thickness of 2 to 3 mm, and this process is repeated predetermined cycles.

Figure 6:
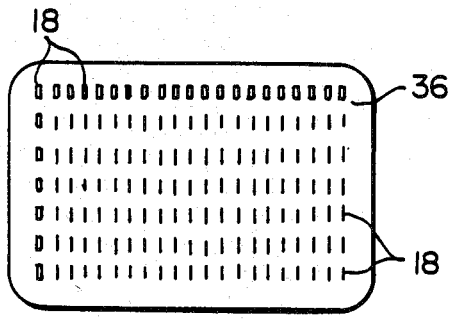
FIGS. 6 to 8 are explanatory views of the ice skating rinks showing the examples of arrangements of the LED-mounting blocks.
Figure 7:
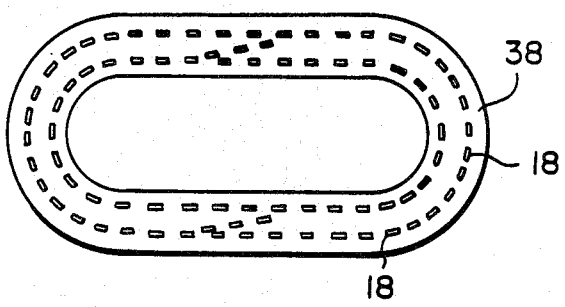
Figure 8:
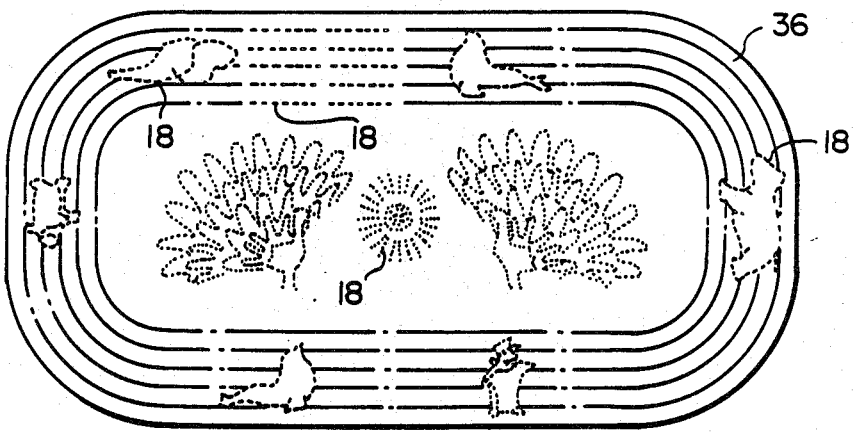

FIGS. 6 to 8 show examples of arrangements of the LED-mounting blocks. FIG. 6 is a plan view, where a multiplicity of mounting blocks 18 are provided over all a rink surface 36. These LED-mounting blocks 18 are connected to a controller to be described hereunder, whereby flickerings of the blocks are individually controlled, so that various luminous patterns can be drawn and color tones can be varied. Furthermore, a combination of the lights and the music makes it possible to improve the color effect. FIG. 7 is a plan view, where an application of the above to a speed skating rink. These blocks 18 are provided over all the skating surface of a speed skating rink 38. These blocks 18 are interlocked with the controller, not shown, whereby the blocks 18 are successively flickered in the circumferential direction of the speed skating rink 38, so that the speed of flickering movement can be controlled to function as a pace maker for skaters. FIG. 8 shows a use example of a multi-purpose rink, where the blocks 18 are arranged along the skating surface of the speed skating rink, which is provided with figures of flowers, animals, birds and the like. With the above-described arrangement, the LED-mounting blocks 18 can be turned on in accordance with the purpose of the amusement or the speed skating race, so that the rink can be utilized under the multi-purposes.

Figure 9:
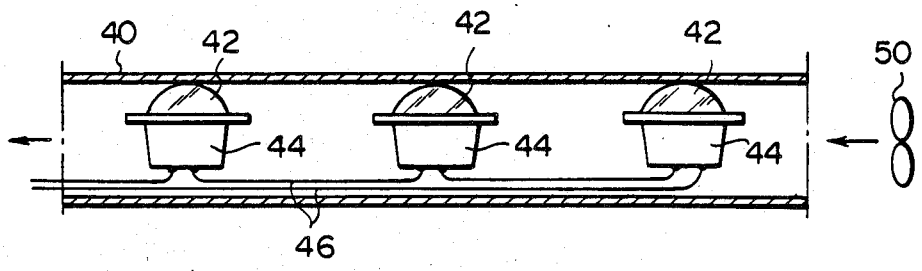
FIG. 9 is a sectional view of the polyethylene tube incorporating therein miniature incandescent bulbs.
Figure 10:
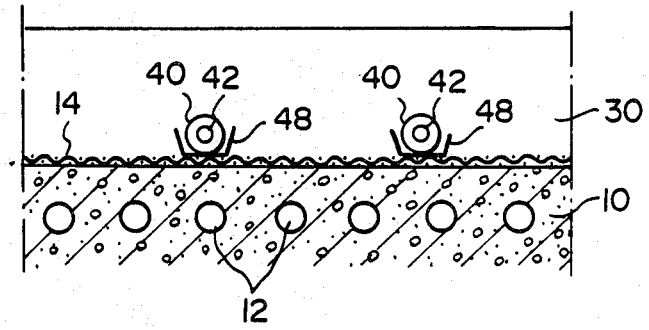
FIG. 10 is a sectional view showing the apparatus for emitting the light in the ice, having the miniature incandescent bulbs as the emission sources, according to this working.

FIG. 9 shows the case of using the miniature incandescent bulbs as the emission sources. The miniature incandescent bulbs 42 are provided at regular intervals in a transparent tube 40. Sockets 44 of the miniature incandescent bulbs 42 are connected to one another in series by a covered wire 46. The miniature incandescent bulbs 42 are applied thereto with a predetermined color coating, whereby, when the bulbs 42 are turned on, various colors are developed. In this working, as shown in FIG. 10, the metal screen 14 is laid on the concrete floor provided therein with the cooling pipes 12, and further, the vinyl chloride tubes 40 incorporating therein the miniature incandescent bulbs 42 as described above are secured to the metal screen 14 through U-shaped rails 48, respectively.

Figure 11:
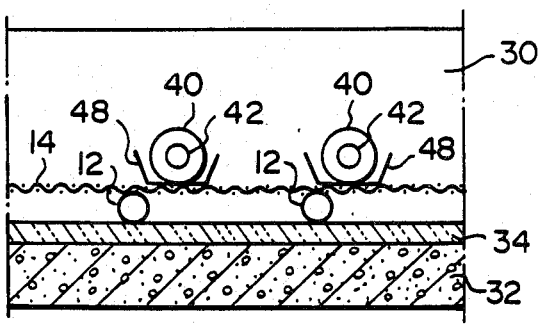
FIG. 11 is a sectional view showing the temporarily provided apparatus for emitting the light in the ice having the incandescent bulbs as the emission sources.

Furthermore, in the case of the temporary works, as shown in FIG. 11, the heat insulating material 34 is laid on the concrete floor 32, further, the cooling pipes 12 are laid on the heat insulating material 34, and the U-shaped rail 48 are secured onto the cooling pipes 12 through the metal screen 14. Secured into the U-shaped rail 48 are the transparent vinyl chloride tubes 40 incorporating therein the miniature incandescent bulbs 42.

The provision of the miniature incandescent bulbs 42 in the vinyl chloride tubes 40 makes it possible to eliminate the necessity of water-proof measure for the miniature incandescent bulbs 42 and to eliminate a possibility of breakage due to the pressure from above the ice because of the strength of the vinyl chloride tubes 42. Furthermore, the miniature incandescent bulb 42 has not the directivity as the LED has, and scatters its light therearound, however, if the U-shaped rail 48 is formed to provide a reflecting surface, then the light is reflected upwardly, so that the figures can float up to the surface of the ice. Furthermore, as shown in FIG. 9, air is delivered to one end of the tube 40 from a fan 50 and discharged from the other end of the tube 40, so that the heat being stagnant in the tube 40 can be dissipated. When the miniature incandescent bulb 42 is used, color coating may be applied to the miniature incandescent bulb 42 itself. However, the transparent vinyl chloride tube may be applied thereto with the color coating for the emission.

Figure 12:
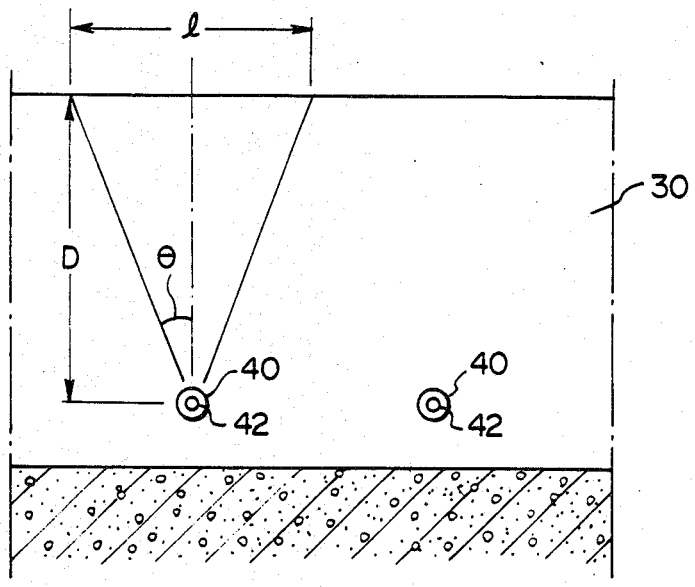
FIG. 12 is an explanatory view showing the mounting pitch of the miniature incandescent bulb.

As for the pitches of the miniature incandescent bulbs 42, if the pitch is too narrow, then the heat release value is increased, thus presenting the disadvantage that the cooling capacity must be increased. If the pitch is too wide, then the lines of the figure to be expected in looking from above the ice are broken off, thus unabling to achieve the initial object. FIG. 12 shows the example of experiments. In an illumination intensity on the ice is 150 Lux, a temperature on the ice surface is −2° C. and a depth D of the ice is 50 mm, then an irradiation angle $\theta$ of the miniature incandescent bulb 42 comes to be 20°–40°, whereby a pitch l of about 60° becomes necessary. When the pitch l is set at about 60 mm, a predetermined figure can float up to the ice surface with the cooling capacity being at the minimum.

In the apparatus for emitting the light in the ice, when the miniature incandescent bulbs are used as the emission sources, the service life of the filaments are limited to several thousand hours. In consequence, disconnection after the lapse of this period of time is not avoidable. Furthermore, in the case of connection in series, when a disconnection occurs, because the emission sources are connected to one another in series, even if the disconnection occurs with only one miniature incandescent bulb, current supply to all of the miniature incandescent bulbs within the circuit is stopped. In order to avoid this, there is proposed a method of connecting the miniature incandescent bulbs and the like in parallel to one another, however, with this arrangement, the disadvantage that the number of wirings are increased is presented.

Figure 13:
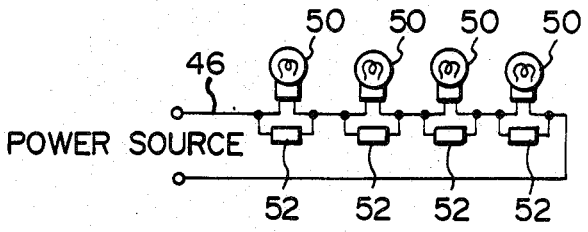
FIG. 13 is a circuit diagram of the apparatus for emitting the light in the ice.

FIG. 13 shows one embodiment of the present invention, to obviate the above-described disadvantages. In this embodiment, a bypass circuit 52 is parallelly connected to the miniature incandescent bulb 50. As the bypass circuit 52, any one of those including a resistor, a circuit using a semiconductor element as a switch member, other elements or parts, etc. can be used as far as it can supply current of capable of turning on the miniature incandescent bulb 50 parallelly connected to it and can also supply current capable of turning on any other miniature incandescent bulb or bulbs at the time of disconnection.

Figure 14:
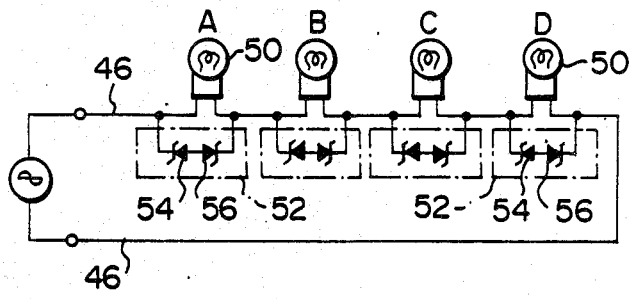
FIG. 14 is a circuit diagram embodying the circuit in FIG. 13.

FIG. 14 shows a specific example of the embodiment shown in FIG. 13. FIG. 14 illustrates the case of alternating current, in which the bypass circuit 52 is constituted by two Zener diodes connected in the opposite directions to each other.

Figure 15:
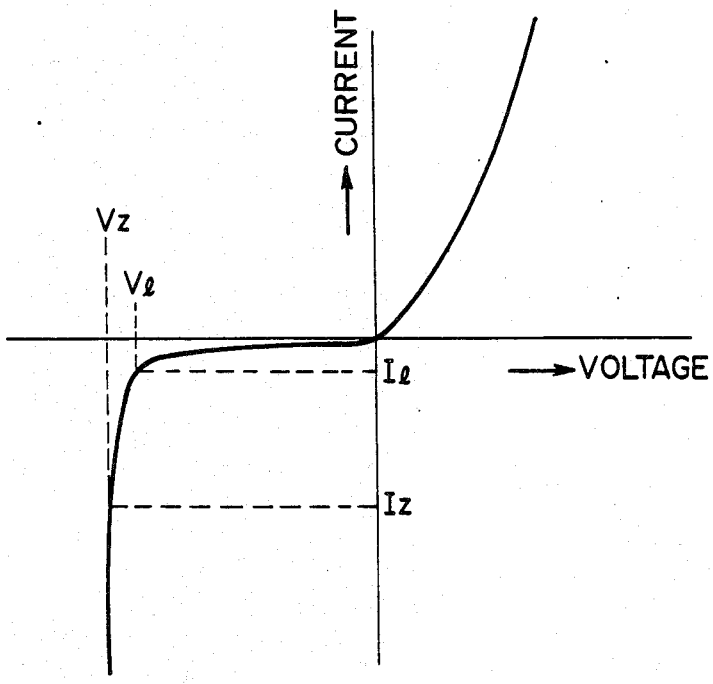
FIG. 15 is a voltage-current characteristics view of a Zener diode.

The Zener diodes 54 and 56 have the voltage-current characteristics shown in FIG. 15, and the characteristics in the reverse direction is the characteristics of maintaining a predetermined voltage (Zener voltage $V_Z$) even if the current flows at $I_Z$ or more (constant voltage characteristics).

Then, when the miniature incandescent bulb 50 is operated at a voltage $V_l$ less than a Zener voltage $V_Z$, a Zener current $I_l$ is passed to the Zener diodes 54 and 56 every semi-cycles of the alternating current. This current $I_l$ is very low and the current of a sufficient value is passed to the miniature incandescent bulb 50 thus parallelly connected, so that the Zener diodes 54 and 56 may be regarded as in non-operation in practical use.

In the circuit of FIG. 14, when one A of the miniature incandescent bulbs 50 (four bulbs including A, B, C and D) is disconnected, as shown in FIG. 15, voltages ($V_l$) at opposite ends of the bypass circuit 52 is raised to a voltage more than the Zener voltage $V_Z$ and flows to the miniature incandescent bulb 50, whereby the current flows to the diodes is raised to a current more than the Zener current $I_Z$. However, the Zener voltage $V_Z$ is maintained due to the constant voltage characteristics of the Zener diodes 54 and 56, and a current having a value approximate to the current which had been flowing to the minimum incandescent bulb before the disconnection flows to the Zener diodes 54 and 56, whereby the state of continuity is established in practice. In consequence, if the Zener voltage $V_Z$ of the Zener diodes 54 and 56 is set at a value slightly higher than that of the operating voltage of the minimum incandescent bulb, and the power capacity thereof is set at a value making allowance for a safety factor of the power consumption of the miniature incandescent bulb 50, the circuit itself can be continuously operated even if disconnection occurs in the miniature incandescent bulb 50.

Figure 16:
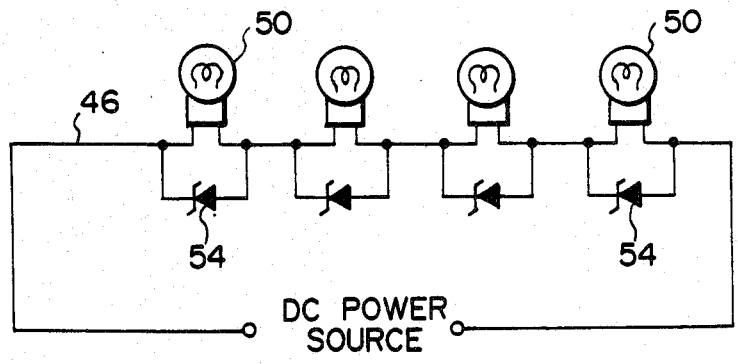
FIG. 16 is a circuit diagram of the apparatus for emitting the light in the ice.

FIG. 16 shows another specific example of the embodiment illustrated in FIG. 13, in which the power source is a direct current one. In this embodiment, one of the Zener diodes in FIG. 14 is removed and connection is made such that the cathode side comes to be the positive pole of the power source. Since no alternation occurs with the direct current, only one Zener diode will do, and the method of setting the Zener diode is identical with the case in FIG. 14, so that detailed description will be omitted.

As has been apparent from the foregoing, the bypass circuits are parallelly connected to the emission sources such as the incandescent bulbs having a possibility of disconnection, respectively, whereby, even if a trouble such as disconnection occurs with the emission source or sources, the circuit can be continuously operated.

Figure 17:
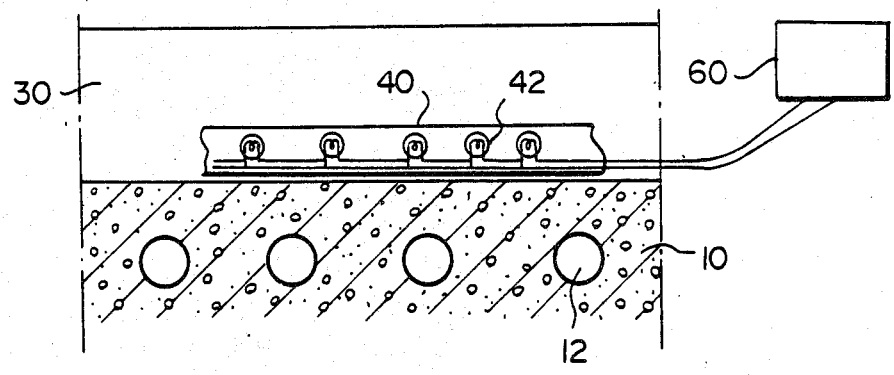
FIG. 17 is a sectional view showing the apparatus for emitting the light in the ice.

In the apparatus for emitting the light in the ice shown in FIG. 17, the ice skating rink is embedded in the rink floor 10 thereof with the cooling pipes 12 and formed on the rink floor thereof with the ice layer 30. The light emitting bodies in the ice are provided in the ice layer 30, are tuned in to a music by means of a controller 60 for example, the miniature incandescent bulbs inserted into the transparent tubes 40, respectively, are formed into a design or designs for flickering, to thereby provide a colorful leisure rink or to successively flicker in synchronism of some type to thereby function as a pace maker for the speed skating. However, the light emitting bodies in the ice are affected by the presence of air bubbles in the ice, the degree of white turbidity and the like, and the illumination intensity of one and the same light emitting body is greatly varied from the looking angles of the skaters and the spectators.

Figure 18:
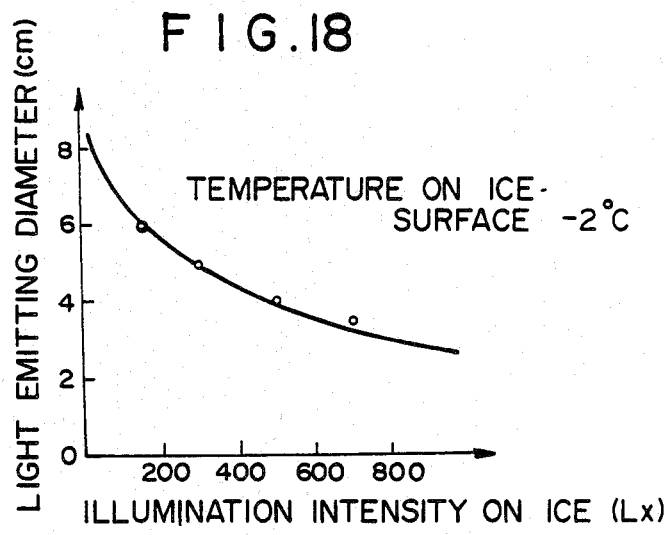
FIG. 18 shows the relationship between the illumination intensity on the ice and the diameter of an emission.
Figure 19:
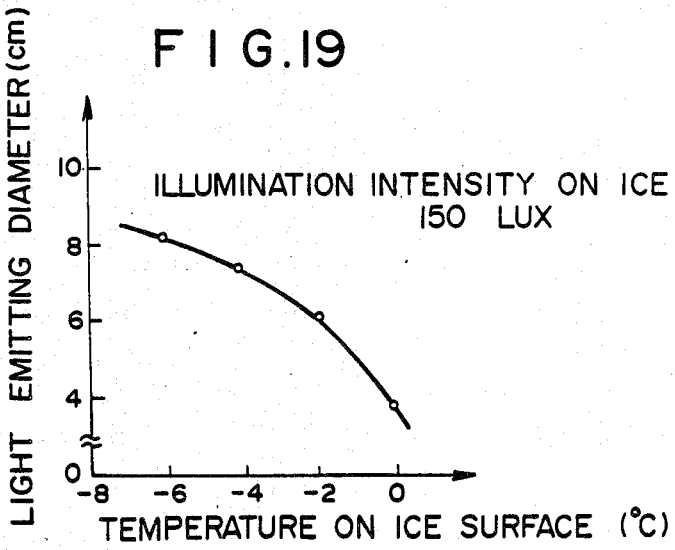
FIG. 19 shows the relationship between the surface temperature of the ice and the diameter of an emission.

FIGS. 18 and 19 have measured the relationship between the diameter of the emission on the ice, the illumination intensity on the ice and the surface temperature of the ice when miniature color bulbs of the rating of 28 V and 25 mA are used as the emission sources in the embodiment of FIG. 17. As shown in FIG. 18, as the illumination intensity on the ice becomes lower, the diameter of the emission seems larger. Furthermore, as shown in FIG. 19, as the surface temperature of the ice becomes lower, the rink surface becomes turbid in white color and the diameter of the emission seems larger. As the surface temperature of the ice is raised and the ice melting on the rink surface is seen, the diameter of the emission seems small and clear.

Then, when the light emitting bodies are used in indicating the lines in a hockey rink, etc. and used as a pace maker for the speed skating, etc., it is preferable that the way of looking from the skaters is held constant even if the temperature of the ice and the illumination intensity on the ice are varied. Furthermore, when the light emitting bodies are utilized in the rink for the leisure, it is preferable that the light emitting bodies are combined with the variation in lightings of the rink as a whole, the variation in music and the like to thereby change the way of looking of the light emitting bodies.

Figure 20:
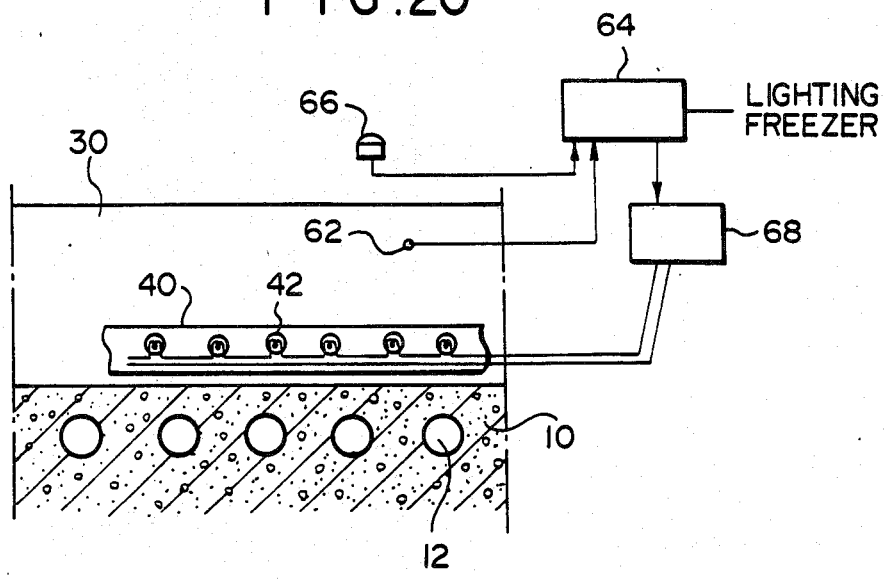
FIG. 20 is an explanatory view showing the method of controlling the apparatus for emitting the light in the ice.

Description will now be given of an embodiment of the present invention made under the above-described circumstances with reference to FIG. 20. Additionally, same reference numerals in FIG. 17 are used to designate same or similar parts corresponding to ones as shown in FIG. 17, so that detailed description will be omitted. A temperature sensor 62 is adapted to measure the temperature of the ice in the rink, and is embedded to a position 10–15 mm deep from the surface of ice. Furthermore, an illumination sensor 66 is adapted to measure an illumination intensity of the ice surface of the rink and therearound. A controller 64 is adapted to control the brightness of the miniature incandescent bulbs 42 on the basis of values from the temperature sensor 62 and the illumination sensor 66 through an adjuster 68, and control a freezer and a light for the lighting, not shown. When the light emitting bodies in the ice are the miniature incandescent bulbs or the like, the adjuster 68 is adapted to change the voltage of the power source in response to a signal from the controller 64, to thereby adjust the brightness. When the light emitting bodies in the ice are the LED or the like, the adjuster 68 is adapted to change a pulse width of the pulse driving (change the duty ratio) to thereby adjust the brightness.

Figure 21:
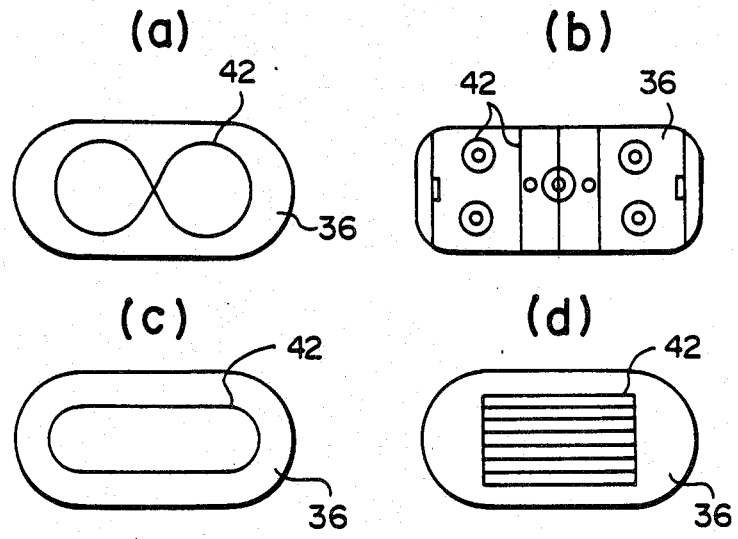
FIGS. 21(*a*), 21(*b*), 21(*c*) and 21(*d*) are explanatory views showing the ice skating rink utilizing the apparatus for emitting the light in the ice according to the present invention.

Description will hereunder be given of action of one embodiment of the present invention. When the line-drawing for use in the ice skating rink as a multi-purpose one is performed by the light emitting bodies in the ice 42, the light emitting bodies 42 are combined with one another to meet various lines and embedded in the ice layer as shown in FIGS. 21(*a*), 21(*b*), 21(*c*) and 21(*d*). In this embodiment, as the light emitting bodies in the ice, emission diodes of a high brightness are used, light emitting lines as shown in FIG. 21(*a*) are adopted for the figure skating, those as shown in FIG. 21(*b*) for the ice hockey, and those as shown in FIGS. 21(*c*) and 21(*d*) for the speed skating. In the case of the figure skating rink, when the rink temperature is controlled to about −3° C. and the illumination intensity on the ice to 500–600 Lux, the repeated frequency of the pulse driving of the LED is controlled to 50 Hz and the duty ratio to 50%, thus enabling to attain a clear line indication. Furthermore, in the case of hockey rink as shown in FIG. 21(*b*), if the rink temperature is controlled to −5° C. and the illumination intensity on the ice to 1300–1500 Lux, then the duty ratio is controlled to 5%, thus enabling to attain a clear line indication and to easily use one and the same rink for the multi-purposes. Furthermore, in the case of the leisure rink, the light emitting bodies in the ice are embedded in various designs, the rink temperature is controlled to about −4° C., the light emitting bodies in the ice are combined with a music, the illumination intensity on the ice is varied to about 50–300 Lux, and the brightness of the light emitting bodies is varied in accordance with the above-described data, so that various effects being colorful and fantastic can be displayed. Needless to say, the light emitting bodies in the ice according to the present invention can be embedded and utilized in the ice carvings carried into the hall of wedding ceremony and the halls of the various events.

As has been described hereinabove, according to the present invention, the temperature of ice and the illumination intensity on the ice are measured, and the brightness of the light emitting bodies in the ice is controlled in accordance with data thus measured, whereby, even if the temperature of ice and the illumination intensity on the ice are varied, the way of looking of the lines from the skaters becomes constant when the light emitting bodies are used as the pace maker for the speed skating. Furthermore, in the case of utilizing the light emitting bodies in the ice for the leisure rink, the way of looking of the light emitting bodies in the ice can be made variable.

Figure 22:
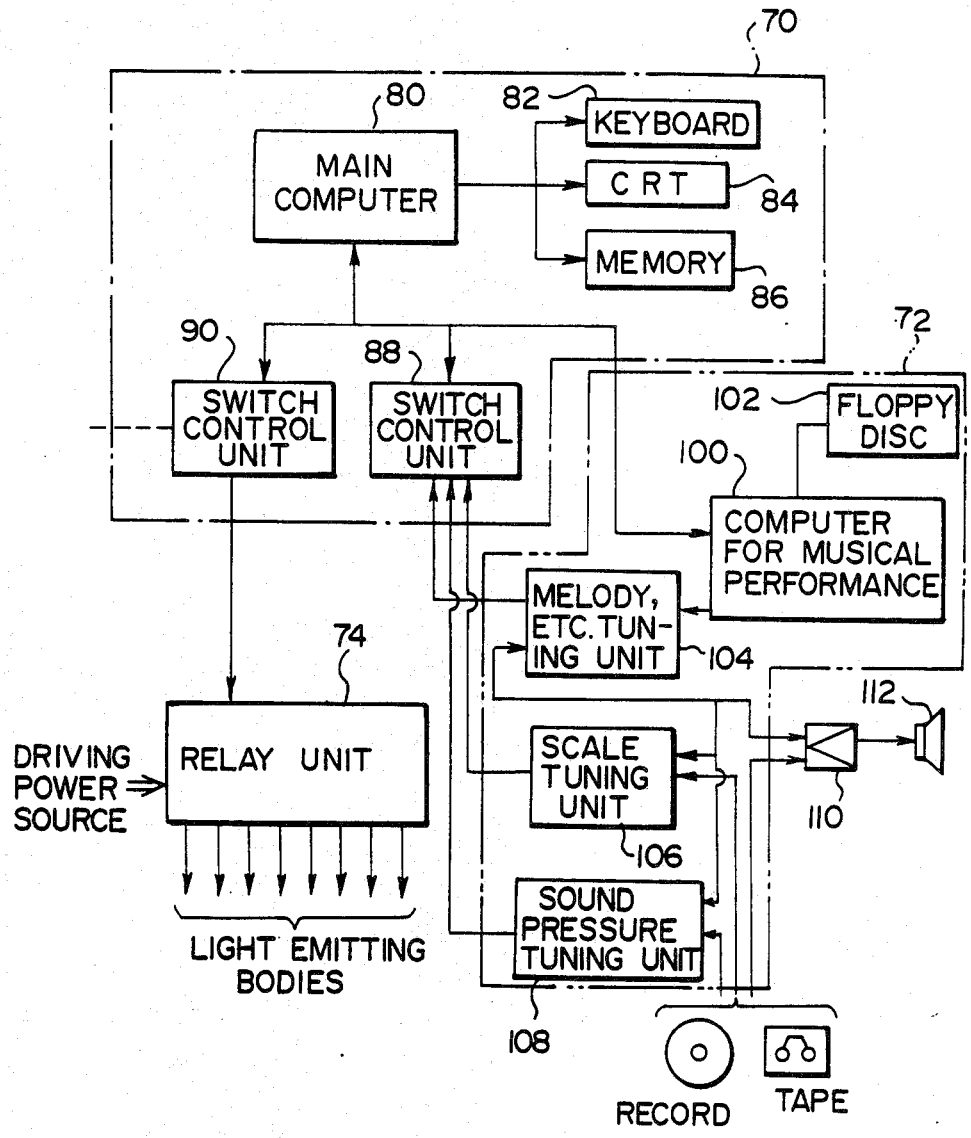
FIG. 22 is a block diagram showing the arrangement of a system for controlling the emission of light in the ice.

FIG. 22 shows one example of the system for controlling the emission of light in the ice. The system for controlling the emission of light in the ice principally comprises:

a control section 70 for tuning the light emitting bodies embedded in the ice in to a music and a lighting from above the ice and controlling the light emitting bodies in flickering, controlling the flickering speed thereof, switching a pattern or patterns to be drawn on the surface of ice, controlling the flow of light (a normal flow and a reverse flow) and so forth; and a musical tuning section 72;

a relay unit 74 including a group of relays for controlling power feed to a plurality of light emitting bodies embedded in the ice.

The control section 70 includes:

a main computer 80 for performing various calculation processes;

a keyboard 82 for specifying a musical program and a pattern or patterns to be drawn on the surface of ice;

a cathode ray tube 84 for monitoring;

a memory 86, such as a floppy disc or a bubble memory, for storing various programs and fixed data; and switch control units 88 and 90.

Further, the musical tuning section 72 includes:

a computer 100 for the musical performance;

a floppy disc 102 for storing performance data such as rhythms, melodies, etc. corresponding to the musical programs;

a melody, etc. tuning unit 104 formed of a synthesizer or the like, producing regenerative signals corresponding the melodies and rhythms of the musical programs;

a scale tuning unit 106 incorporating therein a plurality of frequency filters, for converting into digital signals in accordance with musical scales; and a sound pressure tuning unit 108 for outputting digital signals commensurate to the strengths of sounds inputted.

With the above arrangement, when various data including a musical program to be played, various patterns to be drawn on the surface of ice are inputted through the keyboard 82 and the computer 100 for the musical performance, the main computer 80 delivers control commands to the computer 100 for the musical performance in the musical tuning section 72 and the relay unit 74 on the basis of a program stored in the memory 86.

The computer 100 for the musical performance reads out the performance data of the musical program specified by the floppy disc 72 in response to the control command from the main computer 80, and outputs the data to the melody, etc. tuning unit 104. In the melody, etc. tuning unit 104, melodies and rhythms are prepared from the performance data in accordance with the musical program thereof, regenerative signals thereof are outputted to a speaker 112 through an amplifier 110, whereby the music is delivered to a hall from the speaker 112 and synchronizing signals for tuning in the flickering operations, etc. of the light emitting bodies to the melodies and rhythms produced from the aforesaid performance data are outputted to the main computer 80 through the switch control unit 88.

The main computer 80 delivers signals for controlling the emission of the light emitting bodies such that the flickering speed of the light emitting bodies, the flowing direction of the light and the patterns to be drawn on the surface of ice are varied in a predetermined order in accordance with the timings of the aforesaid synchronizing signals to the relay unit 74 through the switch control unit 90. In the relay unit 74, on or off operation of the respective relays of the relay group interposed between the light emitting bodies and the driving power source are controlled in response to the control signals, whereby the timings of the light emissions and the order of the light emissions of the light emitting bodies are controlled.

On the other hand, when the computer 100 for the musical performance is not used in the musical performance, i.e. when a music is played from a wire broadcasting, a record, a musical tape and the like, the regenerative signals from the above means are outputted to a speaker through the amplifier 110 and outputted to the scale tuning unit 106 and the sound pressure tuning unit 108, respectively. Digital signals commensurate to the scales and the strengths of the sounds are outputted from the scale tuning unit 106 and the sound pressure tuning unit 108 to the main computer 80 through the switch control unit 88. Furthermore, output signals of a computer music by use of the computer 100 for the musical performance can be inputted to the scale tuning unit 106 and the sound pressure tuning unit 108 to be tuned in to the scales and the strengths of the sounds of the computer music in the same manner as described above.

The main computer 80 outputs control signals to control the light emission of the light emitting bodies in response to the above-described output signals to the relay unit 74 through the switch control unit 90.

What is claimed is:

1. A method of emitting light in ice, wherein light emission sources are provided in the ice and the surface of the ice is made luminant by the light emitted from said sources and transmitted through the ice, characterized in that a temperature of ice on the surface of ice is measured and an illumination intensity on the surface of ice and therearound is measured, whereby a brightness of said sources is controlled on the basis of the results of measuring of the temperature of ice and the illumination intensity.

2. An apparatus for emitting light in ice comprising:

light emission sources provided in said ice, for illuminating the surface of the ice by the light emitted from said sources and transmitted through the ice, said light emission sources being light emitting diodes;

cooling pipes provided in or on a concrete floor for cooling water sprayed on the surface of said concrete floor to produce ice;

mounting blocks, to which are secured a plurality of said light emitting diodes;

a metal screen laid on said concrete floor; and guide rails secured to said metal screen and on each of which are provided said mounting blocks.

3. An apparatus for emitting light in ice as set forth in claim 2, wherein said mounting blocks are made of acrylic resin and formed at the central portion thereof with a cutaway opening.

* * * * *